US009651294B2

(12) United States Patent
Kimura et al.

(10) Patent No.: US 9,651,294 B2
(45) Date of Patent: May 16, 2017

(54) OUTDOOR UNIT OF AIR CONDITIONER AND AIR CONDITIONER

(71) Applicant: FUJITSU GENERAL LIMITED, Kanagawa (JP)

(72) Inventors: Takashi Kimura, Kanagawa (JP); Kuniko Hayashi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 560 days.

(21) Appl. No.: 14/198,974

(22) Filed: Mar. 6, 2014

(65) Prior Publication Data

US 2015/0040592 A1 Feb. 12, 2015

(30) Foreign Application Priority Data

Aug. 8, 2013 (JP) ..... 2013-164790

(51) Int. Cl.

| | |
|---|---|
| ***F25D 21/02*** | (2006.01) |
| ***F25B 15/00*** | (2006.01) |
| ***F25D 21/06*** | (2006.01) |
| ***F25B 13/00*** | (2006.01) |
| ***F25D 21/00*** | (2006.01) |
| ***F24F 1/06*** | (2011.01) |
| ***F24F 11/00*** | (2006.01) |

(52) U.S. Cl.

CPC ..... *F25D 21/004* (2013.01); *F24F 1/06* (2013.01); *F24F 11/0086* (2013.01); *F24F 2011/0013* (2013.01); *F24F 2011/0087* (2013.01); *F24F 2011/0089* (2013.01)

(58) Field of Classification Search

CPC ..... F24F 1/06; F24F 2011/0013; F24F 2011/0087; F24F 2011/0089; F25D 21/004

USPC ..... 62/160, 156, 141, 140

See application file for complete search history.

(56) References Cited

U.S. PATENT DOCUMENTS 4,280,332 A * 7/1981 Khan ..... F25D 21/02 340/607
4,338,791 A * 7/1982 Stamp, Jr. ..... F25B 49/02 165/242

(Continued)

FOREIGN PATENT DOCUMENTS

EP 2330359 A1 6/2011
JP 61125539 A2 6/1986

(Continued)

*Primary Examiner* — Henry Crenshaw

(74) *Attorney, Agent, or Firm* — Rankin, Hill & Clark LLP

(57) ABSTRACT

An outdoor unit of an air conditioner includes: an outdoor fan; an outdoor air temperature detector; and a controller, wherein the controller performs: a fan defrost operation to circulate the refrigerant in the same order as in the case of a cooling operation and rotate the outdoor fan when the outdoor air temperature is within a predetermined temperature range, a fan defrost operation over a period of a first fan defrost operation time when the outdoor air temperature is lower than a first predetermined temperature, and a fan defrost operation over a period of a second fan defrost operation time that is longer than the first fan defrost operation time when the outdoor air temperature is equal to or higher than a second predetermined temperature that is higher than the first predetermined temperature.

4 Claims, 3 Drawing Sheets

(56) References Cited

U.S. PATENT DOCUMENTS

| | | | | | |
|---|---|---|---|---|---|
| 4,346,755 | A * | 8/1982 | Alley | F24F 11/0009 165/231 |
| 4,439,995 | A * | 4/1984 | McCarty | F25D 21/002 62/156 |
| 4,538,420 | A * | 9/1985 | Nelson | F25D 21/002 62/140 |
| 4,573,326 | A * | 3/1986 | Sulfstede | F25D 21/006 62/128 |
| 2003/0101738 | A1* | 6/2003 | Yim | F25B 47/025 62/156 |
| 2005/0115252 | A1* | 6/2005 | Karlsson | F25D 21/006 62/141 |
| 2008/0098760 | A1* | 5/2008 | Seefeldt | F25B 1/10 62/238.7 |
| 2011/0209488 | A1 | 9/2011 | Yamada et al. | |

FOREIGN PATENT DOCUMENTS

| | | | |
|---|---|---|---|
| JP | 2003185307 | * | 7/2003 |
| JP | 2003185307 | A2 | 7/2003 |
| JP | 2007051825 | A2 | 3/2007 |
| JP | 2008116156 | A2 | 5/2008 |
| JP | 2010-121789 | | 6/2010 |
| JP | 2013133977 | A2 | 7/2013 |

* cited by examiner

OUTDOOR UNIT OF AIR CONDITIONER AND AIR CONDITIONER

CROSS-REFERENCE TO RELATED APPLICATION

This application is based on Japanese Patent Application No. 2013-164790 filed with the Japan Patent Office on Aug. 8, 2013, the entire content of which is hereby incorporated by reference.

BACKGROUND

1. Technical Field

The present disclosure relates to an air conditioner including an outdoor unit and an indoor unit.

2. Related Art

The outdoor unit of the air conditioner includes an outdoor heat exchanger. The outdoor heat exchanger functions as an evaporator in a heating operation performed. When air outside a room (hereinafter described as the outdoor air) is low in temperature, frost may form on the outdoor heat exchanger. The frost having formed on the outdoor heat exchanger during the heating operation is caused to melt in a reverse cycle defrost operation. The melted frost is discharged as drain water to the outside through a bottom plate of the outdoor unit disposed below the outdoor heat exchanger. In the reverse cycle defrost operation, the outdoor heat exchanger is heated by a refrigerant compressed by a compressor to become hot by circulating the refrigerant through the compressor, the outdoor heat exchanger, and an indoor heat exchanger in this order with an outdoor fan stopped. Moreover, the bottom plate of the outdoor unit functions as a drain pan.

If the heating operation is performed at an outdoor air temperature of approximately 0° C., the amount of frost formation is increased. In this case, frost forms not only on the outdoor heat exchanger, but on the outdoor fan for ventilating the outdoor heat exchanger, a bell mouth in the vicinity of the outdoor fan, and the like. It is difficult to melt the frost forming on the outdoor fan and the like in a normal defrost operation that melts the frost forming on the outdoor heat exchanger. Hence, for example, JP-A-2010-121789 proposes an air conditioner that performs a fan defrost operation for removing the frost forming on the outdoor fan and the like. In the fan defrost operation, if the outdoor air temperature is within a predetermined range after the end of the defrost operation that is performed with the outdoor fan stopped, the outdoor fan is rotated at a predetermined number of revolutions for a fixed period of time while the cycle remains reversed in a refrigerant circuit. Consequently, air heated by the outdoor heat exchanger hits against the outdoor fan, the bell mouth, and the like. As a result, the frost forming on the outdoor fan, the bell mouth, and the like can be melted.

SUMMARY

An outdoor unit of an air conditioner includes: a refrigerant circuit configured to circulate a refrigerant between a compressor, an indoor heat exchanger, and an outdoor heat exchanger, a flow path switch unit included in the refrigerant circuit and configured to switch a flow direction of the refrigerant discharged from the compressor; an outdoor fan; an outdoor air temperature detector configured to detect an outdoor air temperature; and a controller configured to control the outdoor fan and the refrigerant circuit, wherein the controller performs: a fan defrost operation to circulate the refrigerant through the compressor, the outdoor heat exchanger, and the indoor heat exchanger in this order same as in the case of a cooling operation and rotate the outdoor fan when the outdoor air temperature detected by the outdoor air temperature detector is within a predetermined temperature range, a fan defrost operation over a period of a first fan defrost operation time when the outdoor air temperature detected by the outdoor air temperature detector is lower than a first predetermined temperature, and a fan defrost operation over a period of a second fan defrost operation time that is longer than the first fan defrost operation time when the outdoor air temperature detected by the outdoor air temperature detector is equal to or higher than a second predetermined temperature that is higher than the first predetermined temperature.

DETAILED DESCRIPTION

Figure 1:
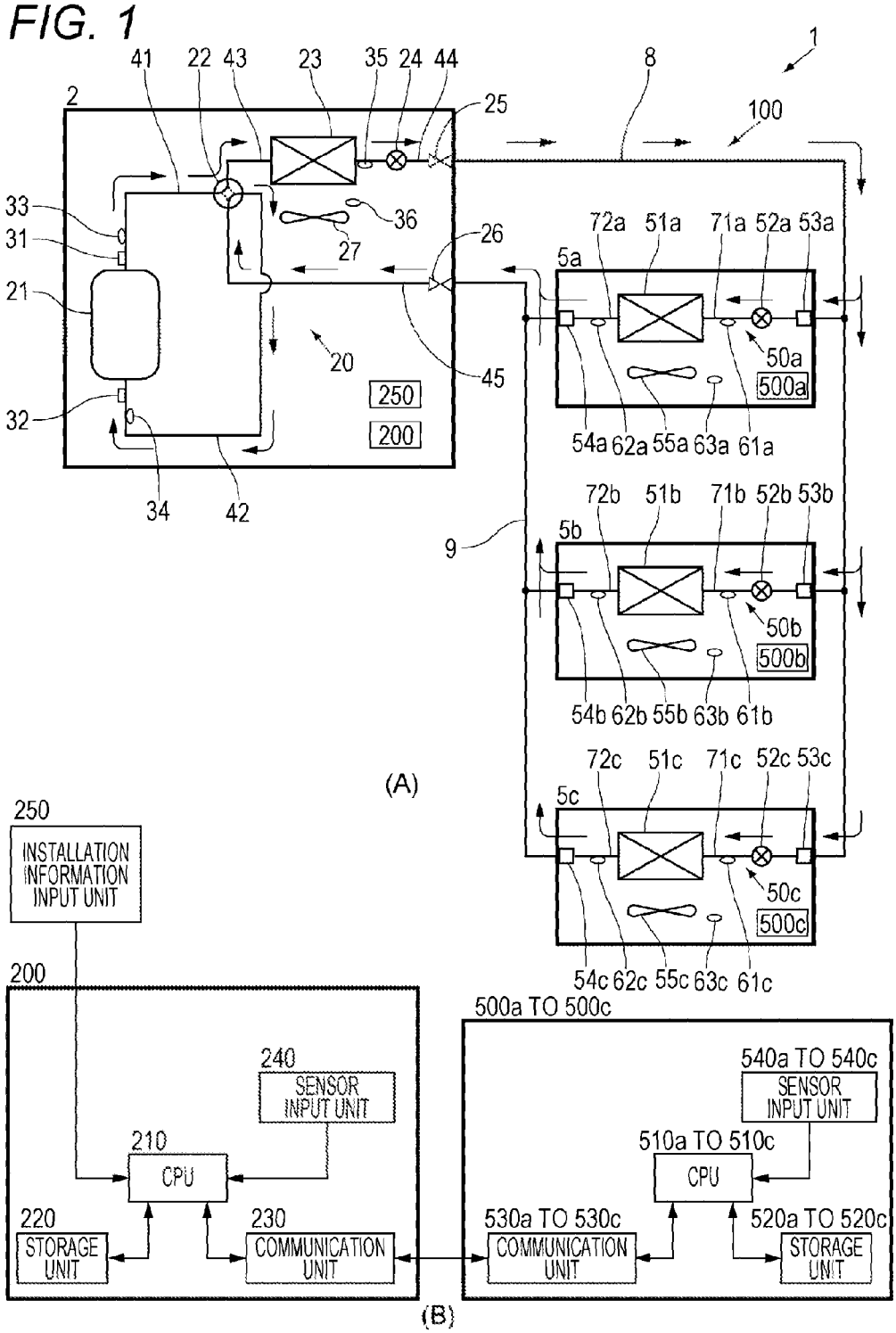
FIG. 1A is a schematic diagram illustrating an air conditioner according to an embodiment of the present disclosure, or a diagram illustrating a refrigerant circuit thereof.
FIG. 1B is a schematic diagram illustrating the air conditioner according to the embodiment of the present disclosure, or a block diagram illustrating an outdoor unit controller and an indoor unit controller.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As described above, the amount of frost forming on an outdoor heat exchanger, an outdoor fan, and the like at an outdoor air temperature of 0° C. is large. However, as the outdoor air temperature decreases below 0° C., the amount of water vapor included in the outdoor air is reduced. Accordingly, the amount of frost forming on the outdoor heat exchanger, the outdoor fan, and the like is also reduced. In other words, the amount of frost forming on the outdoor heat exchanger, the outdoor fan, and the like depends on the outdoor air temperature.

However, the above method performs a fan defrost operation for a fixed period of time regardless of the outdoor air temperature. Hence, if the outdoor air temperature is low, and the amount of frost formation is small, the fan defrost operation may be continued even if the frost has melted. Hence, it may take time to return to a heating operation.

An object of the present disclosure is to provide an air conditioner that can hasten a return to the heating operation by performing the fan defrost operation for an appropriate time.

An outdoor unit of an air conditioner according to an embodiment of the present disclosure (the outdoor unit) performs the fan defrost operation after performing a reverse cycle defrost operation. A fan defrost operation time being a time period during which the fan defrost operation is performed is determined according to the outdoor air temperature. For example, when the outdoor air temperature is a first predetermined temperature, the fan defrost operation is performed for a first fan defrost operation time. When the outdoor air temperature is a second predetermined temperature that is higher than the first predetermined temperature, the fan defrost operation is performed for a second fan defrost operation time that is longer than the first fan defrost operation time.

In the outdoor unit, the fan defrost operation time is determined according to the outdoor air temperature. For example, it is designed to shorten the fan defrost operation time as the outdoor air temperature decreases. Hence, an outdoor fan, a bell mouth, and the like can be defrosted neither too much nor too little. The outdoor unit does not perform the fan defrost operation for a long time that is more than necessary. Hence, a return to the heating operation after the fan defrost operation is hastened.

As illustrated in FIG. 1A, an air conditioner 1 according to the embodiment includes one outdoor unit 2 installed at a place such as outside a building, and three indoor units 5*a* to 5*c*. The indoor units 5*a* to 5*c* are connected in parallel with the outdoor unit 2 by a liquid pipe 8 and a gas pipe 9. The liquid pipe 8 and the gas pipe 9 constitute a refrigerant pipe in the present disclosure. In detail, one end of the liquid pipe 8 is connected to a closing valve 25 of the outdoor unit 2. The other end of the liquid pipe 8 branches to be connected respectively to liquid pipe connection portions 53*a* to 53*c* of the indoor units 5*a* to 5*c*. Moreover, one end of the gas pipe 9 is connected to a closing valve 26 of the outdoor unit 2. The other end of the gas pipe 9 branches to be connected respectively to gas pipe connection portions 54*a* to 54*c* of the indoor units 5*a* to 5*c*. The above configuration configures a refrigerant circuit 100 of the air conditioner 1. The air conditioner according to the embodiment is not limited to this configuration. The air conditioner may include one indoor unit and one outdoor unit, or a plurality of indoor units and a plurality of outdoor units.

<Configuration of Outdoor Unit>

The outdoor unit 2 will be described first. The outdoor unit 2 includes a compressor 21, a four-way valve 22 being a flow path switch, an outdoor heat exchanger 23, an outdoor expansion valve 24, the closing valve 25 to which the one end of the liquid pipe 8 is connected, the closing valve 26 to which the one end of the gas pipe 9 is connected, and an outdoor fan 27. These members excluding the outdoor fan 27 are mutually connected by the refrigerant pipe described in detail below. Consequently, an outdoor unit refrigerant circuit 20 forming a part of the refrigerant circuit 100 is configured.

The compressor 21 is driven by a motor (not shown) whose rotational speed is control by an inverter. Namely, the compressor 21 is a capacity-variable compressor capable of varying operation capacity. A refrigerant discharge side of the compressor 21 is connected to port a (as described below) of a four-way valve 22 through a discharge pipe 41. A refrigerant intake side of the compressor 21 is connected to port c (as described below) of the four-way valve 22 through an intake pipe 42.

The four-way valve 22 is a valve for switching the direction of flow of refrigerant, and includes four ports a, b, c, and d. The port a is connected to a refrigerant discharge side of the compressor 21 through the discharge pipe 41 as described above. The port b is connected to one refrigerant entry/exit opening of the outdoor heat exchanger 23 through a refrigerant pipe 43. The port c is connected to the refrigerant intake side of the compressor 21 through the intake pipe 42 as described above. The port d is connected to the closing valve 26 through an outdoor unit gas pipe 45. Thus, the four-way valve 22 is configured to switch the refrigerant flow path between the compressor 21, the outdoor heat exchanger 23, and the closing valve 26.

The outdoor heat exchanger 23 carries out heat exchange between the refrigerant and outdoor air taken into the outdoor unit 2 by the rotation of the outdoor fan 27 (as described below). The one refrigerant entry/exit opening of the outdoor heat exchanger 23 is connected to the port b of the four-way valve 22 through the refrigerant pipe 43, as described above. The other refrigerant entry/exit opening of the outdoor heat exchanger 23 is connected to the closing valve 25 through an outdoor unit liquid pipe 44.

The outdoor expansion valve 24 is an electronic expansion valve fitted to the outdoor unit liquid pipe 44. By adjusting the opening degree of the outdoor expansion valve 24, the amount of refrigerant that flows into the outdoor heat exchanger 23, or the amount of refrigerant that flows out of the outdoor heat exchanger 23 can be adjusted.

The outdoor fan 27 is formed of, for example, a resin material and is disposed in the vicinity of the outdoor heat exchanger 23. The outdoor fan 27 is rotated by the fan motor (not shown). Thus, the outdoor air is taken into the outdoor unit 2 from a suction opening (not shown), and the outdoor air that exchanges heat with the refrigerant in the outdoor heat exchanger 23 is released from an outlet (not shown) to the outside of the outdoor unit 2.

Other than the configuration described above, the outdoor unit 2 is provided with various sensors. As illustrated in FIG. 1A, the discharge pipe 41 is provided with a high pressure sensor 31 and a discharge temperature sensor 33. The high pressure sensor 31 detects the pressure of the refrigerant discharged out of the compressor 21. The discharge temperature sensor 33 detects the temperature of the refrigerant discharged out of the compressor 21. The intake pipe 42 is provided with a low-pressure sensor 32 and an intake temperature sensor 34. The low-pressure sensor 32 detects the pressure of the refrigerant suctioned into the compressor 21. The intake temperature sensor 34 detects the temperature of the refrigerant suctioned into the compressor 21.

A heat exchanger temperature sensor (heat exchanger temperature detector) 35 is provided to the outdoor heat exchanger 23. The heat exchanger temperature sensor 35 detects frost formation during the heating operation and the melting of the frost during a defrost operation. An outdoor air temperature sensor (outdoor air temperature detector) 36 is provided in the vicinity of the suction opening (not shown) of the outdoor unit 2. The outdoor air temperature sensor 36 detects the temperature of outdoor air flowing into the outdoor unit 2 (hereinafter, simply referred to as "outdoor air temperature").

Moreover, the outdoor unit 2 includes an outdoor unit controller (outdoor unit controller) 200 being a controller in the present disclosure. The outdoor unit controller 200 is mounted on a control board stored in an electrical equipment box (not shown) of the outdoor unit 2. As illustrated in FIG. 1B, the outdoor unit controller 200 includes a CPU 210, a storage unit 220, a communication unit 230, and a sensor input unit 240.

The storage unit 220 includes a ROM and a RAM. The storage unit 220 stores a control program of the outdoor unit 2, detection values corresponding to detection signals from various sensors, control states of the compressor 21 and the outdoor fan 27, a defrost operating condition table described below, and the like. The communication unit 230 is an interface for communicating between the outdoor unit 2 and the indoor units 5*a* to 5*c*. The sensor input unit 240 receives detection results detected by various sensors of the outdoor unit 2 to output the detection results to the CPU 210.

The CPU 210 receives the detection results detected by the sensors of the outdoor unit 2 via the sensor input unit 240. Moreover, the CPU 210 receives control signals transmitted from the indoor units 5*a* to 5*c* via the communication unit 230. The CPU 210 controls the drive of the compressor 21 and the outdoor fan 27 based on the received detection results and control signals. Moreover, the CPU 210 controls the switching of the four-way valve 22 based on the received detection results and control signals. Furthermore, the CPU 210 controls the degree of opening of the outdoor expansion valve 24 based on the received detection results and control signals.

<Configuration of Indoor Unit>

Next, the three indoor units 5*a* to 5*c* will be described. The three indoor units 5*a* to 5*c* are provided with indoor heat exchangers 51*a* to 51*c*, indoor expansion valves 52*a* to 52*c*, the liquid pipe connection portions 53*a* to 53*c*, the gas pipe connection portions 54*a* to 54*c*, and indoor fans 55*a* to 55*c*, respectively. The liquid pipe connection portions 53*a* to 53*c* are connected to the other end of the branched liquid pipe 8. The gas pipe connection portions 54*a* to 54*c* are connected to the other end of the branched gas pipe 9. These members except for the indoor fans 55*a* to 55*c* are mutually connected through refrigerant pipes, as described below. Thus, indoor unit refrigerant circuits 50*a* to 50*c* as part of the refrigerant circuit 100 are formed.

The indoor units 5*a* to 5*c* have identical configurations. Thus, in the following description, the configuration of the indoor unit 5*a* will be described, and the description of the other indoor units 5*b* and 5*c* will be omitted. In FIG. 1, the members of the indoor unit 5*b* corresponding to the members of the indoor unit 5*a* are designated with the signs for the members of the indoor unit 5*a* with the "a" at the end replaced with "b". Similarly, the members of the indoor unit 5*c* corresponding to the members of the indoor unit 5*a* are designated with the signs for the members of the indoor unit 5*a* with the "a" at the end replaced with "c".

The indoor heat exchanger 51*a* carries out heat exchange between the refrigerant and the indoor air taken into the indoor unit 5*a* by an indoor fan 55*a* (as described below) from a suction opening (not shown). One refrigerant entry/exit opening of the indoor heat exchanger 51*a* is connected to the liquid pipe connection portion 53*a* through an indoor unit liquid pipe 71*a*. The other refrigerant entry/exit opening of the indoor heat exchanger 51*a* is connected to the gas pipe connection portion 54*a* through an indoor unit gas pipe 72*a*. The indoor heat exchanger 51*a* functions as an evaporator when the indoor unit 5*a* performs cooling operation. The indoor heat exchanger 51*a* functions as a condenser when the indoor unit 5*a* performs heating operation. The refrigerant pipes of the liquid pipe connection portion 53*a* and the gas pipe connection portion 54*a* are respectively connected to the refrigerant entry/exit openings of the indoor heat exchanger 51*a* by welding, with a flare nut or other parts.

The indoor expansion valve 52*a* is an electronic expansion valve fitted to the indoor unit liquid pipe 71*a*. The opening degree of the indoor expansion valve 52*a* is adjusted based on the required cooling capacity when the indoor heat exchanger 51*a* functions as an evaporator. Similarly, the opening degree of the indoor expansion valve 52*a* is adjusted based on the required heating capacity when the indoor heat exchanger 51*a* functions as a condenser.

The indoor fan 55*a* is formed of, for example, a resin material and is disposed in the vicinity of the indoor heat exchanger 51*a*. The indoor fan 55*a* is rotated by a fan motor (not shown). Thus, the indoor air is taken into the indoor unit 5*a* from a suction opening (not shown). Then, the indoor air exchanges heat with the refrigerant in the indoor heat exchanger 51*a*, followed by being supplied through an outlet (not shown) to the indoor space.

Other than the configuration described above, the indoor unit 5*a* is provided with various sensors. The indoor unit liquid pipe 71*a* is provided with a liquid-side temperature sensor 61*a* between the indoor heat exchanger 51*a* and the indoor expansion valve 52*a*. The liquid-side temperature sensor 61*a* detects the temperature of the refrigerant that flows into the indoor heat exchanger 51*a*, or the temperature of the refrigerant that flows out of the indoor heat exchanger 51*a*. The indoor unit gas pipe 72*a* is provided with a gas-side temperature sensor 62*a*. The gas-side temperature sensor 62*a* detects the temperature of the refrigerant that flows out of the indoor heat exchanger 51*a*, or the temperature of the refrigerant that flows into the indoor heat exchanger 51*a*. In the vicinity of suction opening (not shown) of the indoor unit 5*a*, an indoor temperature sensor 63*a* is provided. The indoor temperature sensor 63*a* detects the temperature of the indoor air that flows into the indoor unit 5*a*, i.e., the indoor temperature.

Moreover, the indoor unit 5*a* includes an indoor unit controller 500*a*. The indoor unit controller 500*a* is mounted on a control board stored in an electrical equipment box (not shown) of the indoor unit 5*a*. As illustrated in FIG. 1B, the indoor unit controller 500*a* includes a CPU 510*a*, a storage unit 520*a*, a communication unit 530*a*, and a sensor input unit 540*a*.

The storage unit 520*a* includes a ROM and a RAM. The storage unit 520*a* stores a control program of the indoor unit 5*a*, detection values corresponding to detection signals from various sensors, information on an air-conditioning operation set by a user, and the like. The communication unit 530*a* is an interface for communicating between the outdoor unit 2 and the other indoor units 5*b* and 5*c*. The sensor input unit 540*a* receives detection results detected by various sensors of the indoor unit 5*a* to output the detection results to the CPU 510*a*.

The CPU 510*a* receives the detection results detected by the sensors of the indoor unit 5*a* via the sensor input unit 540*a*. Moreover, the CPU 510*a* receives a signal including operation information, timer operation information, and the like, which are set by the user operating a remote controller (not shown) via a remote controller light receiving unit (not shown). The CPU 510*a* controls the degree of opening of the indoor expansion valve 52*a*, and the drive of the indoor fan 55*a* based on the received detection results and the signal transmitted from the remote controller. Moreover, the CPU 510*a* transmits a control signal including an operation start/stop signal, and operation information (a set temperature, an indoor temperature, and the like) to the outdoor unit 2 via the communication unit 530*a*.

<Flow of Refrigerant>

Next, the flow of refrigerant and the operation of each member in the refrigerant circuit 100 of the air conditioner 1 according to the present embodiment during an air-conditioning operation will be described with reference to FIG. 1A. In the following description, an example in which the indoor units 5*a* to 5*c* perform cooling operation will be described. A detailed description of an example in which the indoor units 5*a* to 5*c* perform heating operation will be omitted. The arrows in FIG. 1A indicate the flow of refrigerant during cooling operation.

As illustrated in FIG. 1A, when the indoor units 5*a* to 5*c* perform cooling operation, the outdoor unit controller 200 switches the four-way valve 22 to cause the ports a and b to communicate with each other and cause the ports c and d to communicate with each other. The communication between the ports is indicated in FIG. 1A by solid lines. Thus, the outdoor heat exchanger 23 functions as a condenser, while the indoor heat exchangers 51*a* to 51*c* function as evaporators.

The high-pressure refrigerant discharged out of the compressor 21 flows through the discharge pipe 41 into the four-way valve 22. Then the refrigerant flows out of the four-way valve 22 and into the outdoor heat exchanger 23 through the refrigerant pipe 43. The refrigerant that flows into the outdoor heat exchanger 23 exchanges heat with the outdoor air taken into the outdoor unit 2 by the rotation of the outdoor fan 27, whereby the refrigerant is condensed. The refrigerant flows out of the outdoor heat exchanger 23 and then flows through the outdoor unit liquid pipe 44, followed by flowing into the liquid pipe 8 through both the fully opened outdoor expansion valve 24 and the fully opened closing valve 25.

The refrigerant that flows through the liquid pipe 8 is branched and flows into the indoor units 5*a* to 5*c*, respectively. The refrigerant flows through the indoor unit liquid pipes 71*a* to 71*c*, and is depressurized into low-pressure refrigerant when the refrigerant passes the indoor expansion valves 52*a* to 52*c*. The refrigerant that flows into the indoor heat exchangers 51*a* to 51*c* through the indoor unit liquid pipes 71*a* to 71*c* exchanges heat with the indoor air taken into the indoor units 5*a* to 5*c* by the rotation of the indoor fans 55*a* to 55*c*, whereby the refrigerant is evaporated. Thus, the indoor heat exchangers 51*a* to 51*c* function as evaporators, and the indoor air that exchanges heat with the refrigerant in the indoor heat exchangers 51*a* to 51*c* is blown indoor out of an outlet (not shown). In this way, the air of the indoor spaces in which the indoor units 5*a* to 5*c* are installed is cooled.

The refrigerant that flows out of the indoor heat exchangers 51*a* to 51*c* flows through the indoor unit gas pipes 72*a* to 72*c* and into the gas pipe 9. The refrigerant flows through the gas pipe 9 and into the outdoor unit 2 through the closing valve 26. The refrigerant then flows through the outdoor unit gas pipe 45, the four-way valve 22, and the intake pipe 42, and is suctioned into the compressor 21 where the refrigerant is compressed again.

As described above, the refrigerant is circulated through the refrigerant circuit 100 as the air conditioner 1 performs cooling operation.

When the indoor units 5*a* to 5*c* perform heating operation, the four-way valve 22 of the outdoor unit controller 200 is switched to make communication between the ports a and d, and between the ports b and c. In FIG. 1A, the communication between the ports is indicated by broken lines. Thus, the outdoor heat exchanger 23 functions as an evaporator, while the indoor heat exchangers 51*a* to 51*c* function as condensers.

<Regarding Defrost Operation>

If defrost operation start conditions described below are satisfied while the indoor units 5*a* to 5*c* are performing the heating operation, frost may form on the outdoor heat exchanger 23 functioning as an evaporator. The defrost operation start conditions are predetermined by a test and the like. The defrost operation start conditions include, for example, that a refrigerant temperature detected by the heat exchanger temperature sensor 35 after a heating operating time of 30 minutes has passed remains lower by 5° C. or more than the outdoor air temperature detected by the outdoor air temperature sensor 36 for 10 minutes or more. The heating operating time is a time period during which the heating operation is performed continuously from a point in time when the air conditioner 1 is started to start the heating operation, or a point in time when the operation returns from the defrost operation to the heating operation. The defrost operation start conditions further include that a predetermined time (e.g. 180 minutes) has passed from the end of the previous defrost operation. If the defrost operation start conditions are satisfied, frost may be forming on the outdoor heat exchanger 23.

If the defrost operation start conditions are satisfied, the outdoor unit controller 200 (the CPU 210) stops the compressor 21 and stops the heating operation. The outdoor unit controller 200 then switches the refrigerant circuit 100 to the above-mentioned state in the cooling operation and restarts the compressor 21 at a predetermined number of revolutions. Consequently, the defrost operation is started. When the defrost operation is performed, the outdoor fan 27 and the indoor fans 55*a* to 55*c* are at a standstill. However, the operations of the refrigerant circuit 100 other than this are the same as those in the cooling operation. Accordingly, their detailed descriptions are omitted. Moreover, it is preferred that the above-mentioned predetermined number of revolutions of the compressor during the defrost operation be as many as possible (90 rps). A more number of revolutions of the compressor 21 can shorten a defrost operation time at the start of the defrost operation, and the operation can be returned to the heating operation early.

If defrost operation end conditions described below are satisfied while the air conditioner 1 is performing the defrost operation, the frost having formed on the outdoor heat exchanger 23 is considered to have melted. If the defrost operation end conditions are satisfied, the outdoor unit controller 200 stops the compressor 21 to stop the defrost operation. The outdoor unit controller 200 switches the refrigerant circuit 100 to a state in the heating operation. The outdoor unit controller 200 subsequently starts the compressor 21 at the number of revolutions in accordance with the heating capacity required by the indoor units 5*a* to 5*c*. Consequently, the heating operation is resumed.

The defrost operation end conditions are predetermined by a test and the like. The defrost operation end conditions include, for example, that the temperature of the refrigerant flowing from the outdoor heat exchanger 23, the temperature having been detected by the heat exchanger temperature sensor 35, increases to 10° C. or more and that a predetermined time (for example, 10 minutes) has passed from the start of the defrost operation. If the defrost operation end conditions are satisfied, the frost having formed on the outdoor heat exchanger 23 is considered to have melted.

Next, the operation, action, and effect of the refrigerant circuit in the air conditioner 1 according to the embodiment will be described with reference to FIGS. 1A to 3.

<Regarding Fan Defrost Operation>

Firstly, the fan defrost operation will be described. The fan defrost operation is an operating mode for melting frost forming on the outdoor fan 27, a bell mouth (not shown), and the like when a condition to start the fan defrost operation (hereinafter described as the fan defrost operation start condition) is satisfied. The fan defrost operation start condition is predetermined by a test and the like. The fan defrost operation start conditions include, for example, an outdoor air temperature To detected by the outdoor air temperature sensor 36 immediately before the start of the defrost operation (hereinafter described as the determination outdoor air temperature Toj) is −10° C. or more and 0° C. or less.

The determination outdoor air temperature Toj used to determine whether or not the fan defrost operation start condition is satisfied may not be the outdoor air temperature To detected by the outdoor air temperature sensor 36. The determination outdoor air temperature Toj may be another temperature such as an average value of a plurality of the outdoor air temperatures To detected during the heating operation. Moreover, when the fan defrost operation is performed, the outdoor fan 27 rotates at a minimum number of revolutions (for example, 290 rpm) at the instruction of the CPU 210. If the fan defrost operation start condition is satisfied, frost is considered to have formed on the outdoor fan 27, the bell mouth (not shown), and the like.

Figure 3:
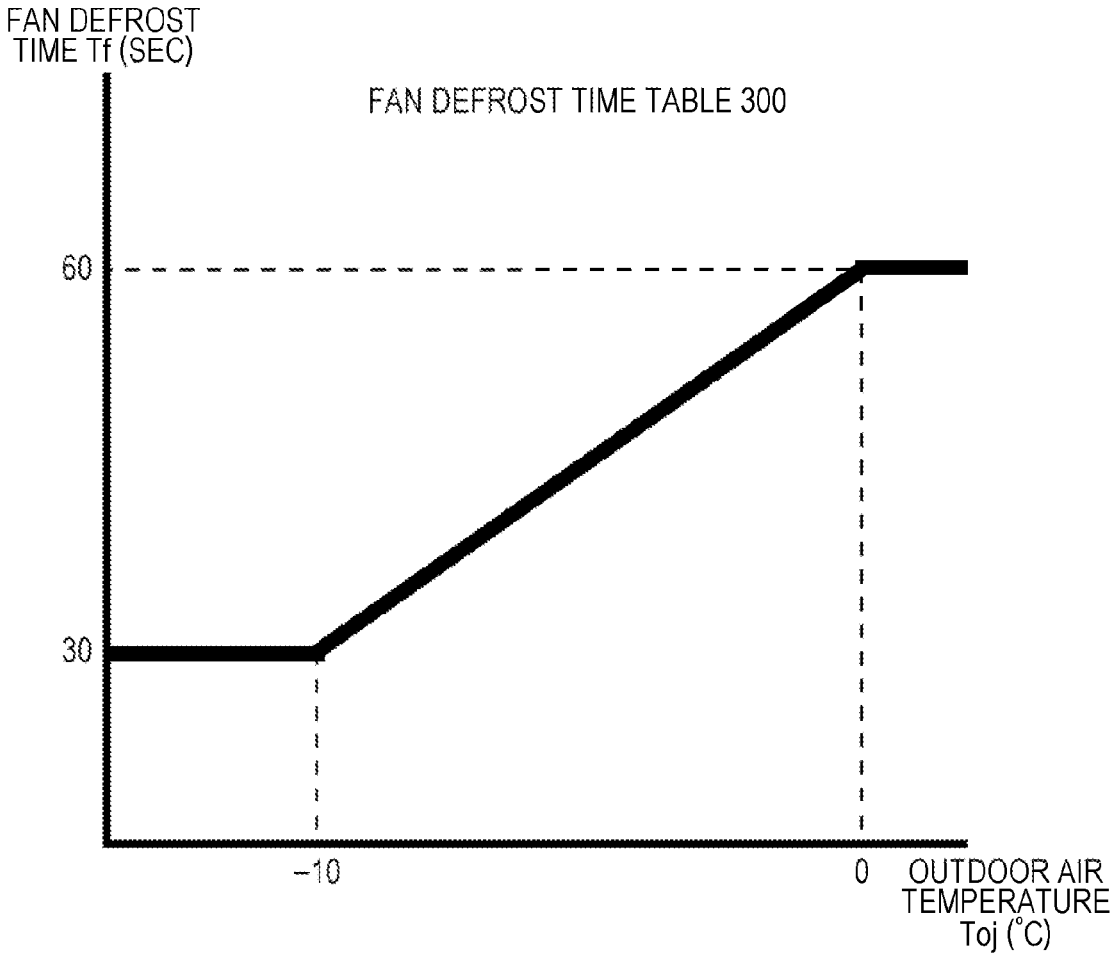
FIG. 3 is a graph illustrating a relationship between outdoor air temperature and a fan defrost operation time of the air conditioner illustrated in FIGS. 1A and 1B.

A fan defrost time table 300 illustrated in FIG. 3 is stored in the storage unit 220 included in the outdoor unit controller 200 of the outdoor unit 2. A different fan defrost operation time Tf is determined according to the determination outdoor air temperature Toj in the fan defrost time table 300. If the determination outdoor air temperature Toj is less than a first predetermined temperature (for example, −10° C.), the outdoor unit controller 200 (the CPU 210) sets the fan defrost operation time Tf to a first fan defrost operation time (for example, 30 seconds). If the determination outdoor air temperature Toj is a second predetermined temperature (for example, 0° C.) or more, the outdoor unit controller 200 (the CPU 210) sets the fan defrost operation time Tf to a second fan defrost operation time (for example, 60 seconds). If the determination outdoor air temperature Toj is, for example, −10° C. or more and less than 0° C., the outdoor unit controller 200 (the CPU 210) gradually extends the fan defrost operation time Tf as the determination outdoor air temperature increases from −10° C. to 0° C.

The fan defrost operation time Tf is determined by, for example, a predetermined calculation equation (Tf=determination outdoor air temperature×3+60). In the embodiment, the first predetermined temperature is set to −10° C., the second predetermined temperature to 0° C., the first fan defrost operation time to 30 seconds, and the second fan defrost operation time to 60 seconds. However, the present disclosure is not limited to them. These values may be changed as appropriate depending on the installation conditions of the outdoor unit. Moreover, the first predetermined temperature may be set to a lower limit temperature at which the operation of the air conditioner is guaranteed. Furthermore, in the embodiment, if the determination outdoor air temperature Toj is the first predetermined temperature or more and less than the second predetermined temperature, the fan defrost operation time Tf gradually becomes longer as the outdoor air temperature increases from −10° C. to 0° C. However, the present disclosure is not limited to this. The fan defrost operation time Tf may change in stages according to the determination outdoor air temperature Toj.

Figure 2:
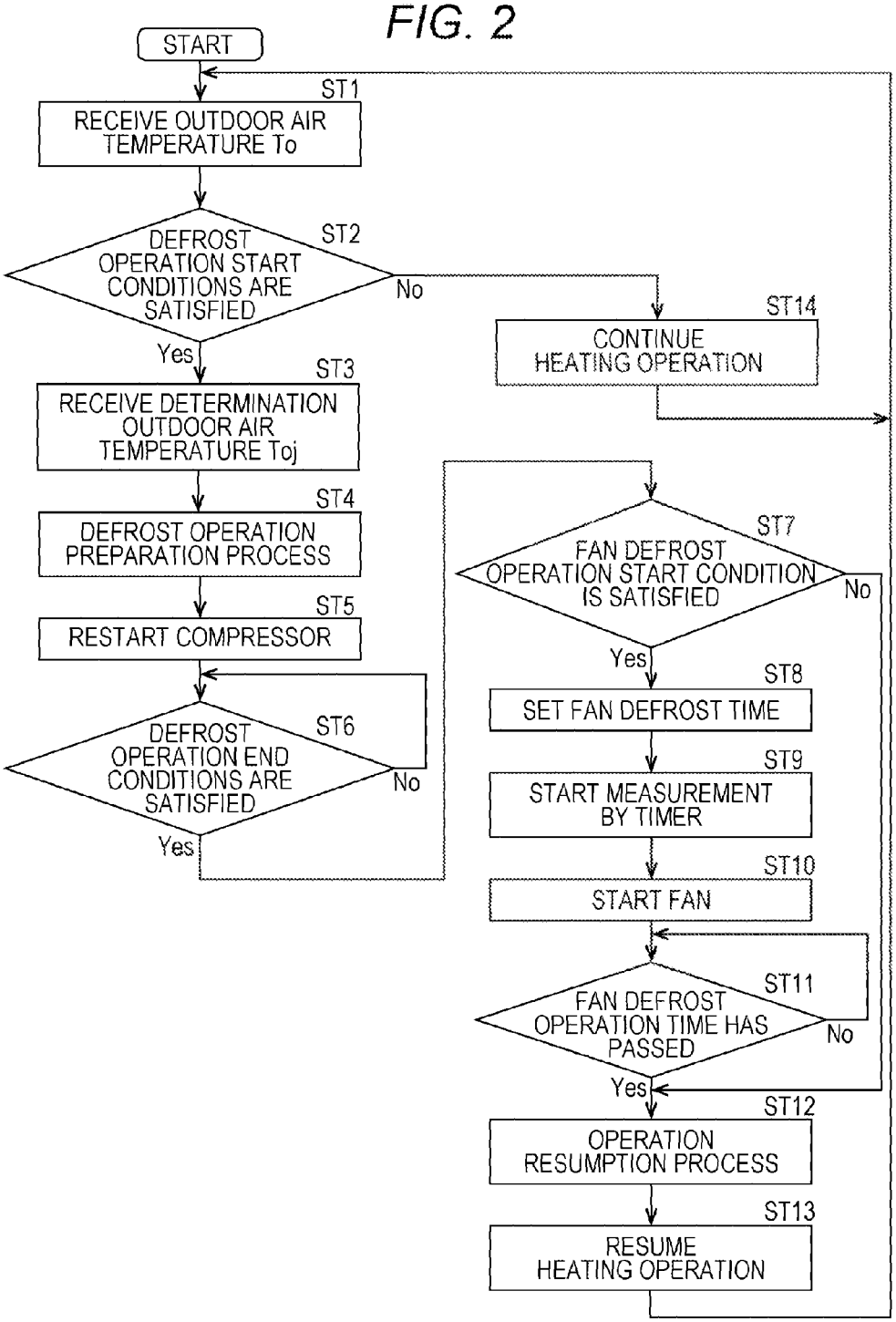
FIG. 2 is a flowchart illustrating a process in a defrost operation of the air conditioner illustrated in FIGS. 1A and 1B.

Next, the control of when the air conditioner 1 of the embodiment performs the defrost operation and the fan defrost operation will be described with reference to FIGS. 1A to 3. FIG. 2 illustrates the flow of processes to be performed by the CPU 210 of the outdoor unit controller 200 when the air conditioner 1 performs the defrost operation. In FIG. 2, ST denotes a step. A numeral after the step denotes a step number. In FIG. 2, the processes related to the present disclosure are focused and described. Therefore, descriptions of processes other than them, for example, general processes related to the air conditioner such as the control of the refrigerant circuit in accordance with the operating conditions such as the temperature and quantity of air that are set by the user are omitted.

<Description of Control Procedure>

When the air conditioner 1 is performing the heating operation, the CPU 210 regularly receives the outdoor air temperature To detected by the outdoor air temperature sensor 36. The receive temperature, together with the time, is stored in the storage unit 220 (ST1). The CPU 210 refers to the stored outdoor air temperature To and determines whether or not a state where the outdoor air temperature To remains 0° C. or lower for 30 minutes or more, in other words, whether or not the defrost operation start conditions have been satisfied (ST2).

If the defrost operation start conditions have not been satisfied in ST2 (ST2—No), the CPU 210 continues the heating operation (ST14), and returns the processing to ST1. If the defrost operation start conditions have been satisfied in ST2 (ST2—Yes), the CPU 210 receives the determination outdoor air temperature Toj from the outdoor air temperature sensor 36 (ST3). The CPU 210 then performs a defrost operation preparation process (ST4). In the defrost operation preparation process, the CPU 210 stops the compressor 21 and the outdoor fan 27, and switches the four-way valve 22 so as to cause the ports a and b to communicate with each other as well as cause the ports c and d to communicate with each other. Consequently, in the refrigerant circuit 100, the outdoor heat exchanger 23 functions as a condenser, and the indoor heat exchangers 51*a* to 51*c* function as evaporators. In other words, the refrigerant circuit 100 becomes the cooling operation state illustrated in FIG. 1A. In the defrost operation, the CPUs 510*a* to 510*c* of the indoor units 5*a* to 5*c* stop the indoor fans 55*a* to 55*c*. Next, the CPU 210 restarts the compressor 21 at a predetermined number of revolutions (ST5). Consequently, the defrost operation is started.

Next, the CPU 210 determines whether or not the defrost operation end conditions are satisfied (ST6). The defrost operation end conditions are, for example, that the temperature of the refrigerant flowing from the outdoor heat exchanger 23, the temperature having been detected by the heat exchanger temperature sensor 35, increases to 10° C. or more. The CPU 210 regularly receives the refrigerant temperature detected by the heat exchanger temperature sensor 35 and stores the refrigerant temperature together with the time in the storage unit 220. The CPU 210 refers to the stored refrigerant temperature and determines whether or not the refrigerant operation end conditions such as that the refrigerant temperature increases to 10° C. or more, and that a predetermined time (for example, 10 minutes) has passed from the start of the defrost operation are satisfied. The defrost operation end conditions are predetermined by a test and the like. If the defrost operation end conditions are satisfied, the frost having formed on the outdoor heat exchanger 23 is considered to have melted.

If the defrost operation end conditions are not satisfied in ST6 (ST6—No), the CPU 210 returns the processing to ST6 to continue the defrost operation. If the defrost operation end conditions are satisfied (ST6—Yes), the CPU 210 determines whether or not the fan defrost operation start condition is satisfied (ST7). The fan defrost operation start condition is, for example, whether or not the determination outdoor air temperature Toj is within a predetermined temperature range (for example, —10° C. or more and 0° C. or less). If the fan defrost operation start condition is not satisfied (ST7—No), the CPU 210 advances the processing to ST12.

If the fan defrost operation start condition is satisfied (ST7—Yes), the CPU 210 sets the fan defrost operation time Tf (ST8). For example, if the determination outdoor air temperature Toj is 0° C. or more, the CPU 210 sets the fan defrost operation time Tf to 60 seconds. Moreover, for example, if the determination outdoor air temperature Toj is less than −10° C. the CPU 210 sets the fan defrost operation time Tf to 30 seconds. If the determination outdoor air temperature Toj is less than 0° C. and −10° C. or more, the CPU 210 sets as the fan defrost operation time Tf a value calculated by the determination outdoor air temperature Toj×3=60.

Next, the CPU 210 starts measurement by a timer (ST9) and starts the outdoor fan 27 (ST10).

Next, the CPU 210 determines whether or not the fan defrost operation time Tf has passed (ST11). If the fan defrost operation time Tf has not passed (ST11—No), the CPU 210 returns the processing to ST11 to continue the fan defrost operation. If the fan defrost operation time Tf has passed (ST11—Yes), the CPU 210 performs a process to resume the heating operation (ST12). In the operation resumption process, the CPU 210 stops the compressor 21 and switches the four-way valve 22 to cause the ports a and d to communicate with each other and cause the ports b and c to communicate with each other. Consequently, in the refrigerant circuit 100, the outdoor heat exchanger 23 functions as an evaporator, and the indoor heat exchangers 51*a* to 51*c* function as condensers.

The CPU 210 then resumes the heating operation (ST13), and returns the processing to ST1. In the heating operation, the CPU 210 controls the numbers of revolutions of the compressor 21 and the outdoor fan 27 and the degree of opening of the outdoor expansion valve 24 in accordance with the operation capacity required by the indoor units 5*a* to 5*c*.

As described above, in the air conditioner of the present disclosure, as the determination outdoor air temperature Toj decreases, the fan defrost operation time Tf is shortened. Consequently, the fan defrost operation can be efficiently performed without waste. As a result, the air conditioner can return to the heating operation as immediately as possible after the frost melts.

The defrost operation end conditions may include, for example, whether or not the temperature of the refrigerant flowing from the outdoor heat exchanger 23, the temperature having been detected by the heat exchanger temperature sensor 35, has increased to 10° C. or more, and whether or not the predetermined time (for example, 10 minutes) has passed from the start of the defrost operation. The fan defrost operation start condition may be, for example, whether or not the determination outdoor air temperature Toj is −10° C. or more and 0° C. or less.

Moreover, the air conditioner of the present disclosure can be expressed as the following first and second air conditioners.

The first air conditioner includes a refrigerant circuit where a refrigerant circulates through a compressor, an indoor heat exchanger, and an outdoor heat exchanger in this order during a heating operation, the refrigerant circuit including a flow path switch unit for switching a flow direction of the refrigerant discharged from the compressor, an outdoor fan, an outdoor air temperature detection unit for detecting an outdoor air temperature, and a control unit for controlling the outdoor fan and the refrigerant circuit. The control unit stops the outdoor fan, and controls the flow path switch unit to perform a defrost operation for circulating the refrigerant through the compressor, the outdoor heat exchanger, and the indoor heat exchanger in this order, and then, if the outdoor air temperature detected from the outdoor air temperature detection unit immediately before the start of the defrost operation is within a predetermined temperature range, performs a fan defrost operation for circulating the refrigerant in the same order as in the case of the defrost operation and rotating the outdoor fan. In terms of a fan defrost operation time being a time period during which the fan defrost operation is performed, if the outdoor air temperature is a first predetermined temperature, a first fan defrost operation time is determined, and if the outdoor air temperature is a second predetermined temperature that is higher than the first predetermined temperature, a second fan defrost operation time that is longer than the first fan defrost operation time is determined.

In the second air conditioner according to the first air conditioner, if the outdoor air temperature is less than the first predetermined temperature, the first fan defrost operation time is determined, if it is the second predetermined temperature or more, the second fan defrost operation time is determined, if the outdoor air temperature is the first predetermined temperature or more and less than the second predetermined temperature, the fan defrost operation time is determined to become longer at a predetermined rate as the outdoor air temperature increases.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An outdoor unit of an air conditioner comprising:

a refrigerant circuit configured to circulate a refrigerant between a compressor, an indoor heat exchanger, and an outdoor heat exchanger;

a flow path switch unit included in the refrigerant circuit and configured to switch a flow direction of the refrigerant discharged from the compressor;

an outdoor fan;

an outdoor air temperature detector configured to detect an outdoor air temperature; and a controller configured to control the outdoor fan and the refrigerant circuit, wherein the controller performs:

a fan defrost operation to circulate the refrigerant through the compressor, the outdoor heat exchanger, and the indoor heat exchanger in this order same as in the case of a cooling operation and rotate the outdoor fan when the outdoor air temperature detected by the outdoor air temperature detector is within a predetermined temperature range, a fan defrost operation over a period of a first fan defrost operation time when the outdoor air temperature detected by the outdoor air temperature detector is lower than a first predetermined temperature, and a fan defrost operation over a period of a second fan defrost operation time that is longer than the first fan defrost operation time when the outdoor air temperature detected by the outdoor air temperature detector is equal to or higher than a second predetermined temperature that is higher than the first predetermined temperature.

2. The outdoor unit of an air conditioner according to claim 1, wherein when the outdoor air temperature detected by the outdoor air temperature detector is equal to or higher than the first predetermined temperature and lower than the second predetermined temperature, the controller extends the fan defrost operation time at a predetermined rate as the outdoor air temperature increases and performs the fan defrost operation.

3. The outdoor unit of an air conditioner according to claim 1, wherein the number of revolutions of the outdoor fan while performing the fan defrost operation is a minimum number of revolutions.

4. An air conditioner comprising:

the outdoor unit according to claim 1; and an indoor unit connected to the outdoor unit.

* * * * *